US010309076B2

(12) United States Patent
Veter

(10) Patent No.: US 10,309,076 B2
(45) Date of Patent: Jun. 4, 2019

(54) SAFETY LANDING

(71) Applicant: Access Industrial Inc., Mississauga (CA)

(72) Inventor: Paul Edward Veter, Dundas (CA)

(73) Assignee: Access Industrial Inc., Mississauga (CA)

( * ) Notice: Subject to any disclaimer, the term of this patent is extended or adjusted under 35 U.S.C. 154(b) by 0 days.

(21) Appl. No.: 15/478,323

(22) Filed: Apr. 4, 2017

(65) Prior Publication Data

US 2017/0284054 A1 Oct. 5, 2017

Related U.S. Application Data

(60) Provisional application No. 62/318,431, filed on Apr. 5, 2016.

(51) Int. Cl.
*E02D 29/12* (2006.01)

(52) U.S. Cl.
CPC ..... *E02D 29/122* (2013.01); *E02D 29/127* (2013.01)

(58) Field of Classification Search
CPC ..... E02D 29/122; E02D 29/127; E04G 3/20; E04G 3/246
See application file for complete search history.

(56) References Cited

U.S. PATENT DOCUMENTS 3,038,555 A * 6/1962 Da Lee ..... E06C 7/006 182/128
3,166,154 A * 1/1965 Titzel ..... C21C 5/44 182/128
3,289,788 A * 12/1966 Evans ..... E04G 1/362 182/128
4,323,140 A * 4/1982 Foscarini ..... E02D 29/12 182/128
5,707,067 A * 1/1998 Smith ..... B25H 5/00 280/32.6

(Continued)

FOREIGN PATENT DOCUMENTS

CN 203383241 * 1/2014
CN 203383241 U 1/2014
GB 2410283 A * 7/2005 ..... E02D 29/127

OTHER PUBLICATIONS http://translationportal.epo.org/emtp/translate/?ACTION=description-retrieval&COUNTRY=CN&ENGINE=google&FORMAT=docdb&KIND=U&LOCALE=en_EP&NUMBER=203383241&OPS=ops.epo.org/3.2&SRCLANG=zh&TRGLANG=en (Year: 2018).*

*Primary Examiner* — Katherine W Mitchell
*Assistant Examiner* — Candace L Bradford
(74) *Attorney, Agent, or Firm* — Bereskin & Parr LLP/S.E.N.C.R.L., S.R.L.

(57) ABSTRACT

A safety landing may include a first support panel positionable within the shaft and having a first support surface and a second support surface spaced apart from the first support surface. At least a first platform may have a first end that is movably connected to the first support panel and a second end spaced apart from the first end. The first platform may have an upper surface, an opposing lower surface and an end surface at the first end. The first platform may be movably between a closed position in which the first platform extends laterally across the shaft, and in which the lower surface rests on the first support surface and an open position in which the first platform is generally upright and the end surface of the first platform rests on the second support surface.

21 Claims, 11 Drawing Sheets

(56) References Cited

U.S. PATENT DOCUMENTS

| | | | | |
|---|---|---|---|---|
| 6,431,789 | B2 | 8/2002 | Schneider et al. | |
| 6,830,127 | B2 | 12/2004 | Johnson | |
| 9,133,629 | B2 * | 9/2015 | Copeland | E04F 19/10 |
| 2010/0032240 | A1 | 2/2010 | Fernandez | |
| 2013/0294873 | A1 * | 11/2013 | Chastain, Jr. | B60P 1/435<br>414/523 |
| 2017/0284054 | A1 * | 10/2017 | Veter | E02D 29/127 |

* cited by examiner

SAFETY LANDING

CROSS-REFERENCE TO RELATED APPLICATION

This application claims the benefit of 35 USC 119 based on the priority of U.S. Provisional Patent Application 62/318,431 filed Apr. 5, 2016, which is incorporated herein in its entirety by reference.

FIELD

The present subject matter of the teachings described herein relates generally to safety landings for use in longitudinally extending shafts, and in particular, relates to safety landings having platforms that can be retained in an open position.

BACKGROUND

U.S. Pat. No. 4,323,140 (Foscarini et al.) discloses a safety platform for use in a vertical shaft such as a manhole. The platform comprises a pair of support beams with the ends of each support beam mounted in the wall of the shaft. At least one panel extends across the shaft and bridges the support beams with a novel wedge clip at one end of the panel to allow the panel to be opened or secured in the closed position. A novel pivoting means is provided at the other end of the panel which pivotally secures the panel to the opposite support beam. The platform may be installed easily with fewer problems than the prior art yet provides increased safety factors for the user.

U.S. Pat. No. 9,133,629 (Copeland) discloses a safety apparatus adapted for retrofitting vertical enclosures is shown. The safety apparatus may include a support frame, a grate platform, and telescoping support legs adapted to fasten to an enclosure wall. The apparatus may also include a hinged hatch defining an opening configured to allow a person to be pulled through the platform.

SUMMARY

This summary is intended to introduce the reader to the more detailed description that follows and not to limit or define any claimed or as yet unclaimed invention. One or more inventions may reside in any combination or sub-combination of the elements or process steps disclosed in any part of this document including its claims and figures.

In accordance with one broad aspect of the teachings disclosed herein, a safety landing for use in a longitudinally extending shaft can include a first support panel positionable within the shaft. The first support panel may include at least one attachment portion for attaching to the shaft, a first support surface and a second support surface spaced apart from the first support surface. At least a first platform may have a first end that is movably connected to the first support panel and a second end spaced apart from the first end. The first platform may have an upper surface, an opposing lower surface and an end surface at the first end. The first platform being movable between a closed position, in which upper surface of the platform is upward facing to support a user and the first platform extends laterally across the shaft, and in which the lower surface rests on the first support surface; and an open position in which the first platform is generally upright and the end surface of the first platform rests on the second support surface.

The first platform may be pivotably and translatable connected to the first support panel and may be lifted and pivoted relative to the first support panel when moving between the open position and the closed position An abutment surface may be spaced apart from the first and second support surfaces. When the first platform is in the closed position the upper surface may be spaced from the abutment surface, and when the first platform is in the open position the upper surface may be adjacent and may face the abutment surface, and optionally may bear against or otherwise engage the abutment surface.

When the first platform is in the open position, engagement between the abutment surface and the upper surface and between the end surface and the second support surface may help inhibit the first platform from pivoting relative to the first support panel whereby the first platform is self-locking in the open position. Optionally, the first platform may only be pivoted from the open position to the closed position after the first platform has been translated upwardly so that the abutment surface is spaced from the upper surface and that end surface is spaced from the second support surface.

Optionally, the first platform may only be pivoted from the open position to the closed position after the first platform has been translated upwardly so that the end surface is longitudinally above the abutment surface.

The abutment surface may extend between a laterally inner edge of the first support surface to a laterally outer edge of the second support surface.

The abutment surface may be generally orthogonal to the second support surface.

Optionally, when the first platform is pivoted from the closed position toward the open position engagement between at least one of the lower surface and end surface and the first support surface may help lift the first platform relative to the first support panel until the first platform reaches an alignment position in which the lower surface and end surface are spaced apart from the first support surface. The first platform may fall from the alignment position to the open position under the influence of gravity.

The second support surface may be longitudinally below the first support surface and optionally may be laterally inboard of the first support surface.

The first support surface may be generally parallel to the second support surface.

A hinge bracket may connect the first platform to the first support panel. Optionally, one of the hinge bracket and the first platform may include a slot and a pin that pivotally connects the hinge bracket and the first platform may be pivotally and translatably received within the slot.

The first support panel may include a downward facing anchor surface that may underlie the second support surface and a longitudinally extending sidewall may extend between the second support surface and the anchor surface. The hinge bracket may have first, second and third bearing surfaces that abut the second support surface, the anchor surface and the sidewall respectively.

The anchor surface may also underlie the first support surface. The hinge bracket may include a fourth bearing surface that abuts the first support surface.

Optionally, one of the hinge bracket and the first support panel may include an integrally formed attachment protrusion that extends through an aperture formed in the other one of the hinge bracket and the sidewall and is secured using a fastener, thereby fastening the hinge bracket and first support panel together.

The aperture may be provided in the sidewall of the first support panel.

Optionally, both the attachment portion and the fastener may be made of the same material as the hinge bracket and the first support panel.

The first support panel may be of integral, one-piece construction.

The first support panel further may include a receiving surface for supporting the lower surface of a second platform extending from an opposing second support panel positioned within the shaft.

The receiving surface may be laterally spaced apart from the first support surface.

The receiving surface may be co-planar with the first support surface.

Optionally, the safety landing may also include a second support panel positionable within the shaft opposite the first support panel. The second support panel may include at least one attachment portion for attaching to the shaft, a first support surface and a second support surface spaced apart from the first support surface. A second platform may have a first end that is movably connected to the second support panel and a second end spaced apart from the first end. The second platform may have an upper surface, an opposing lower surface and an end surface at the first end. The second platform may be movable between a closed position in which upper surface of the second platform is upward facing to support a user and the second platform extends laterally across the shaft, and in which the lower surface of the second platform rests on the first support surface of the second support panel, and an open position in which the second platform is generally upright and the end surface of the second platform rests on the second support surface of the second support panel.

The first support panel may include a first receiving surface that is spaced apart from the first support surface and the second support panel may include a second receiving surface that is spaced apart from the first support surface on the second support panel. When the first and second platforms are in the closed position the lower surface of the first platform may rest on the second receiving surface and the lower surface of the second platform may rest on the first receiving surface.

The first support surface may have a first depth in the lateral direction and the second support surface may have a second depth in the lateral direction that is between about 1.5 and 2.5 times the first depth.

The spacing between the upper and lower surfaces may define a first platform thickness and the second support surface may have a second depth in the lateral direction that is between 50% and about 150% of the first platform thickness.

DRAWINGS

The drawings included herewith are for illustrating various examples of articles, methods, and apparatuses of the teaching of the present specification and are not intended to limit the scope of what is taught in any way.

Figure 1:
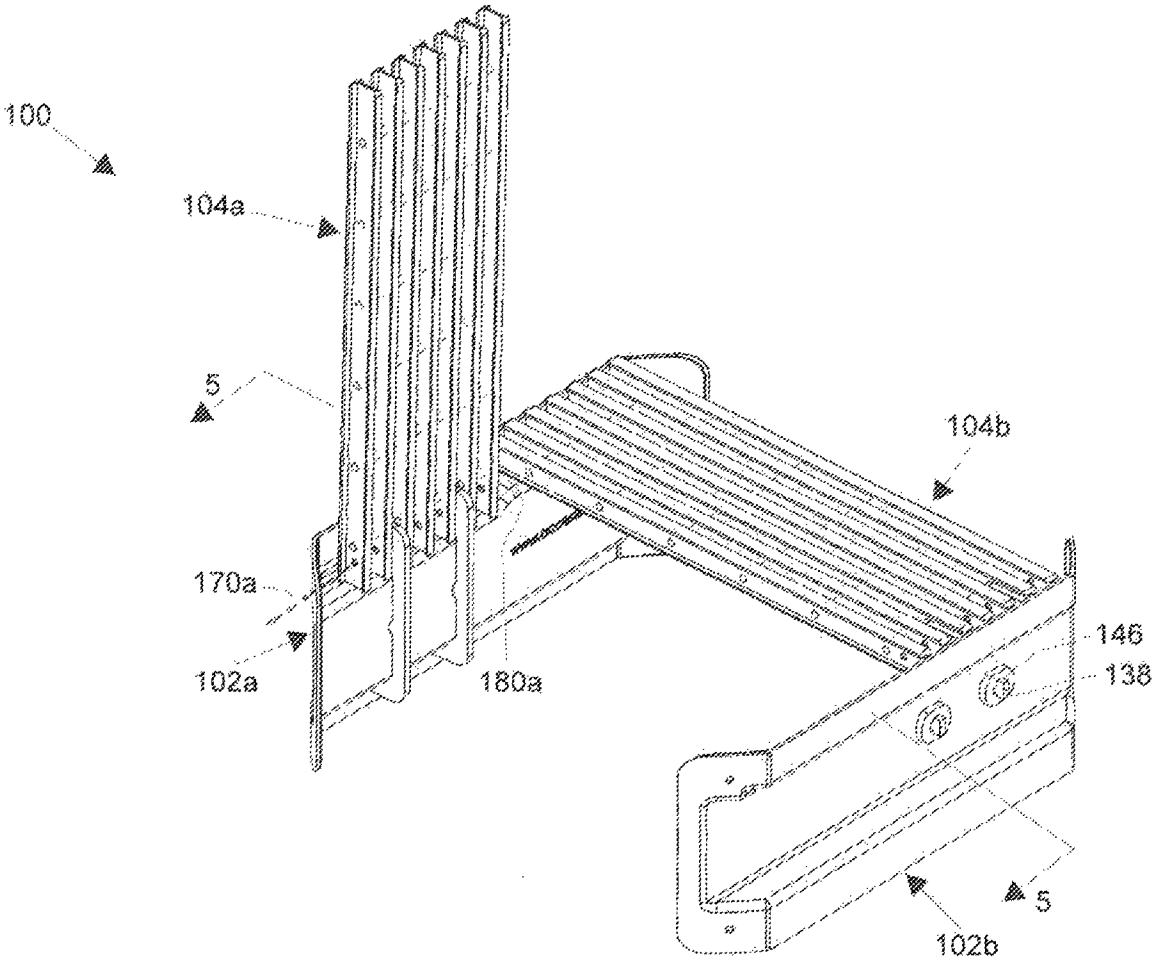
FIG. 1 is a perspective view of one example of a safety landing.
Figure 4:
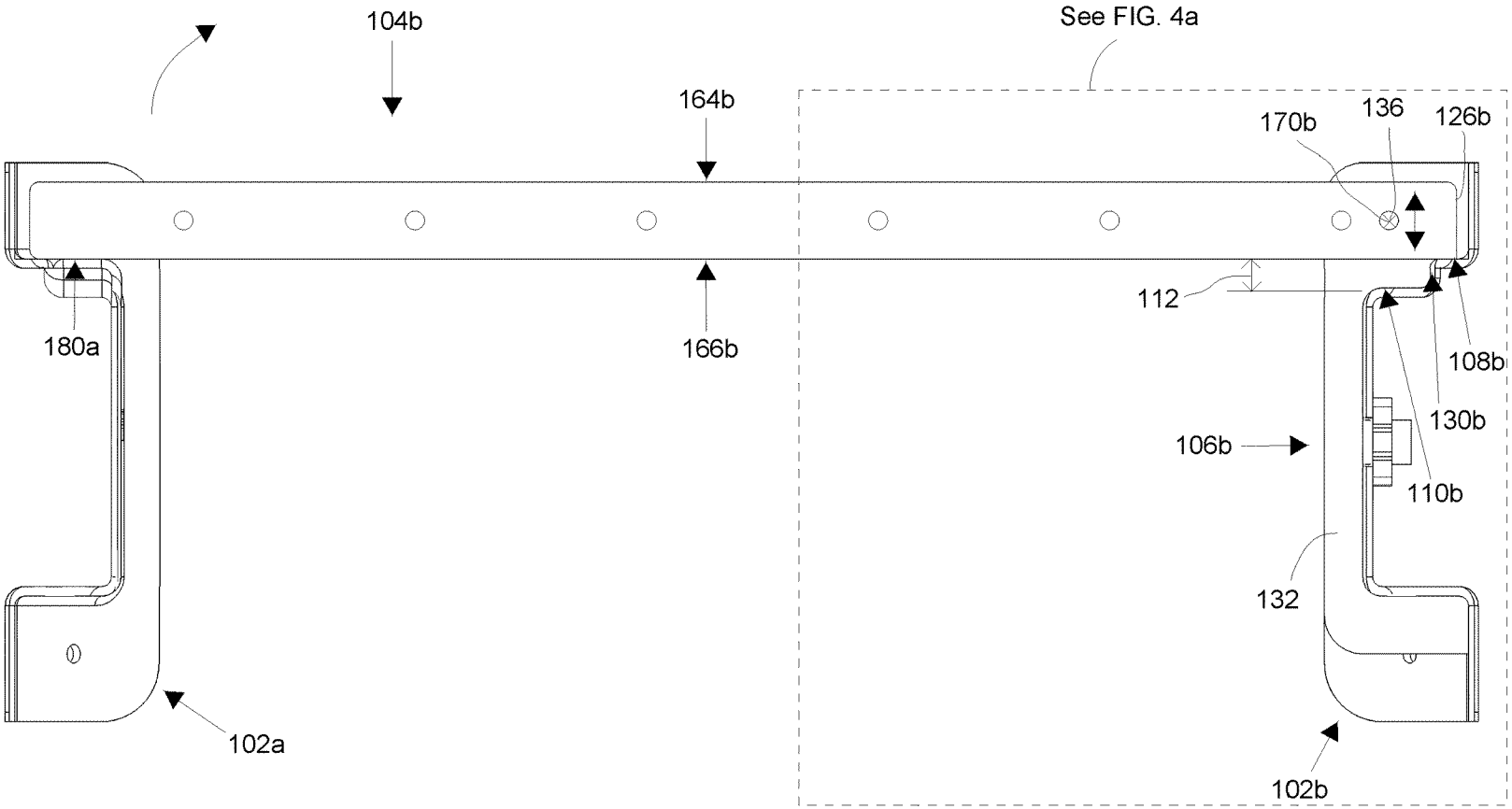
FIG. 4 is a cross-sectional view of the safety landing of FIG. 1, taken along line 4-4.
Figure 4A:
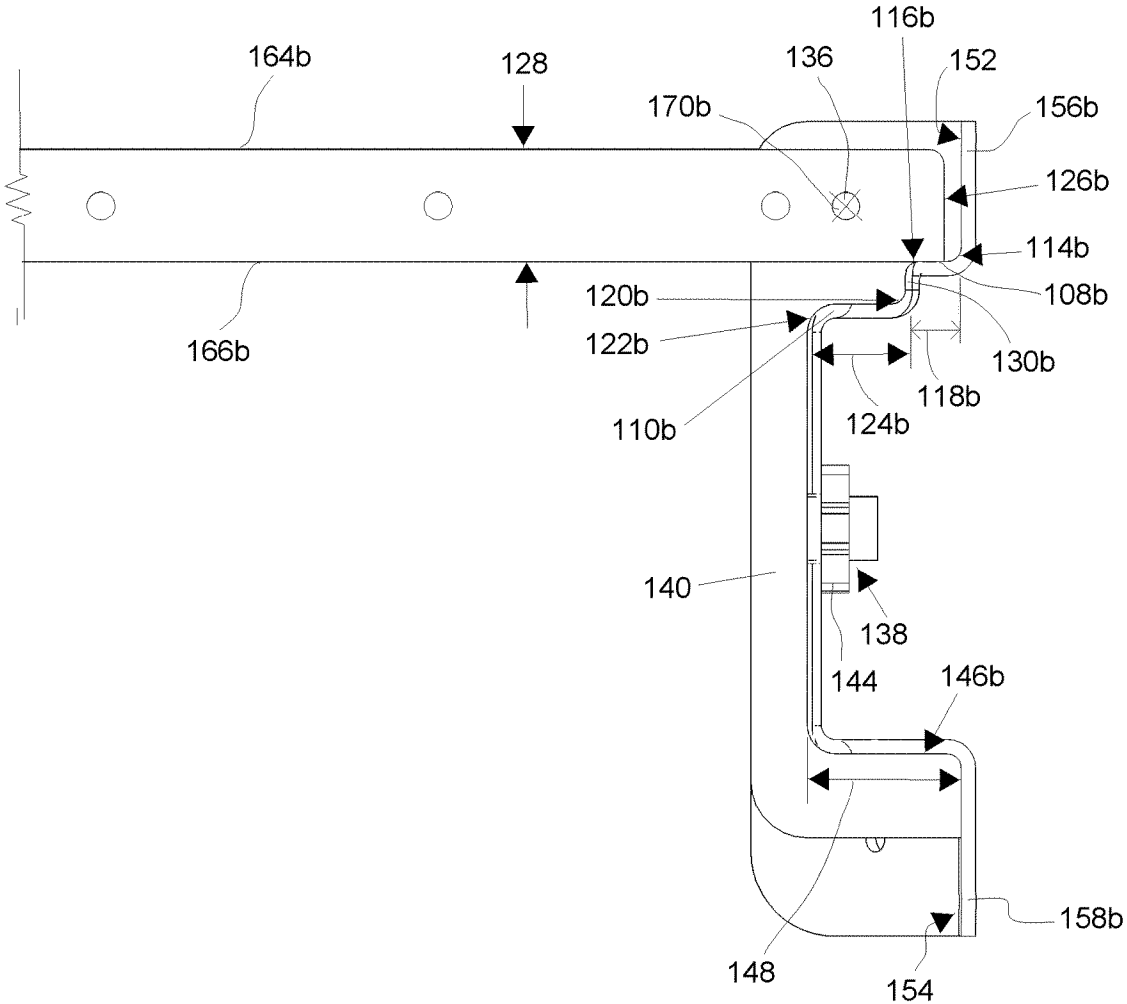
Figure 5:
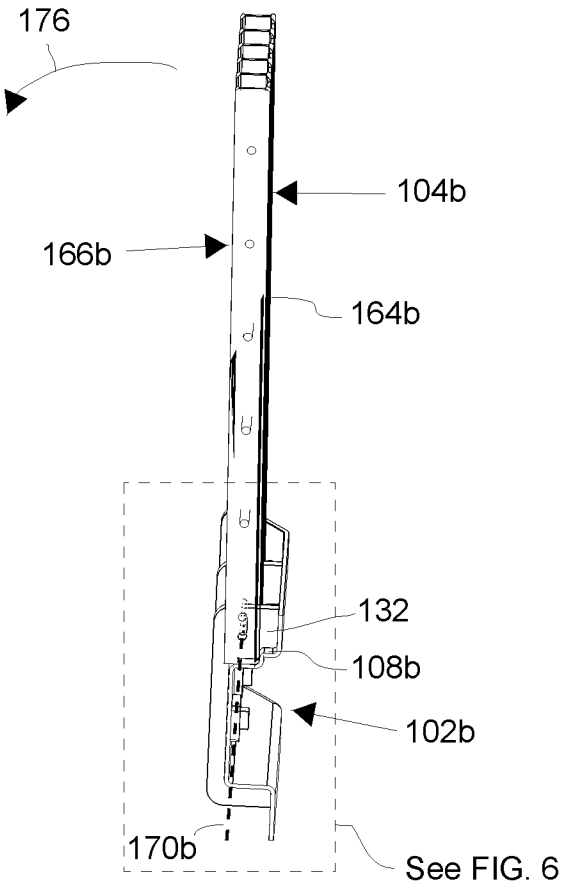
Figure 5:
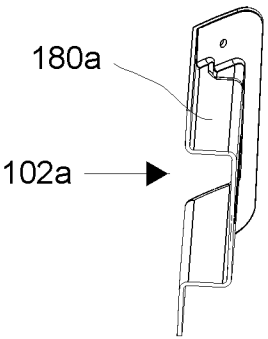
Figure 6:
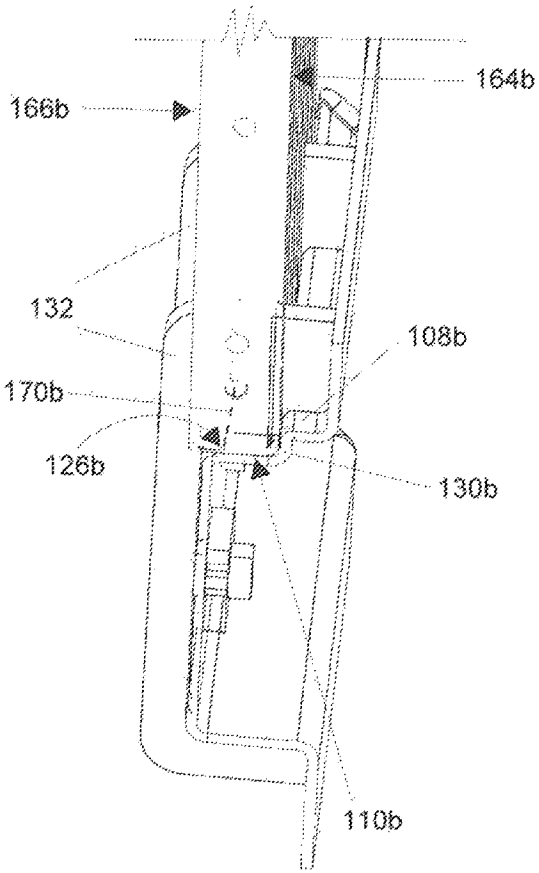
Figure 7:
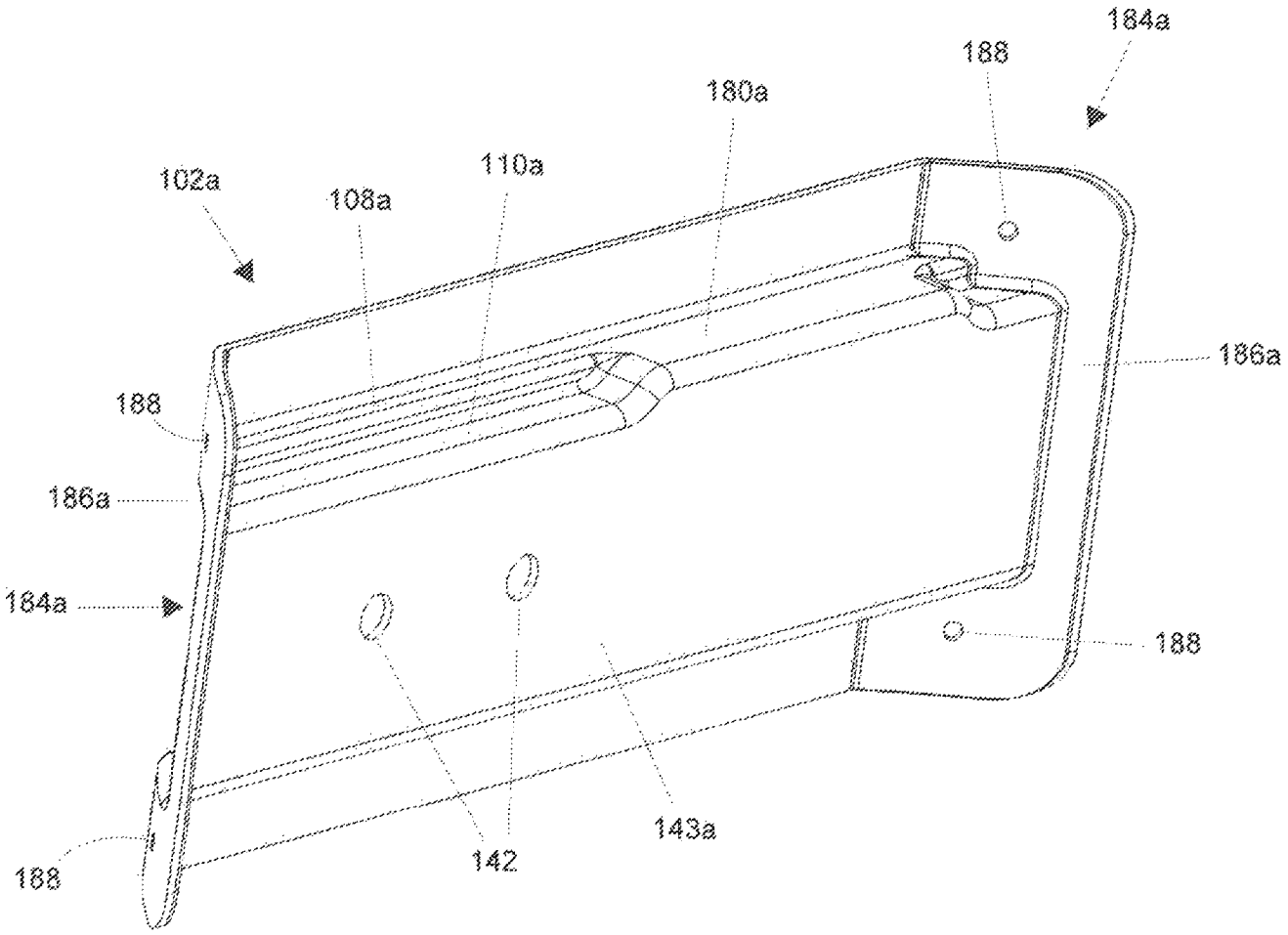
Figure 8:
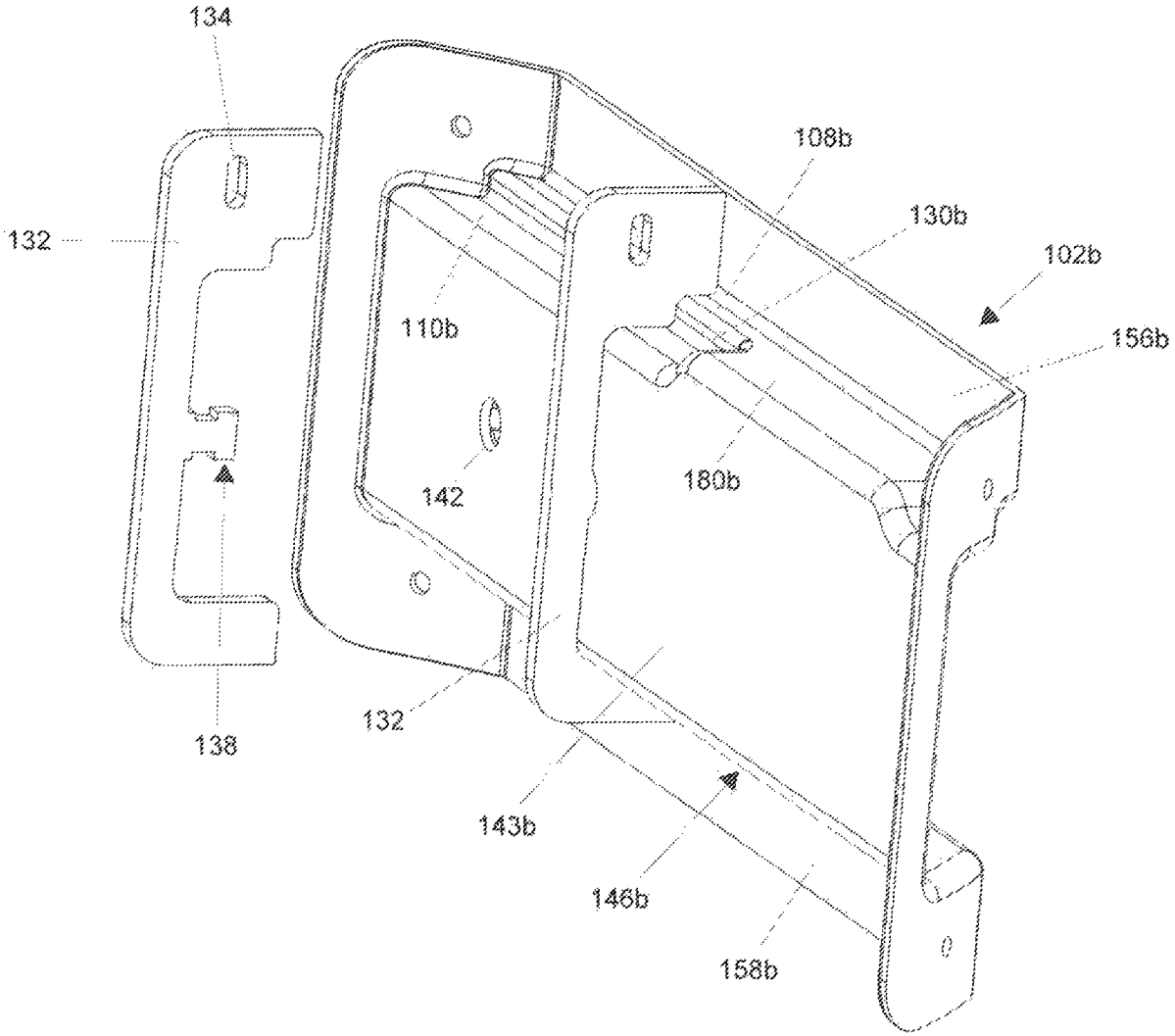
Figure 9:
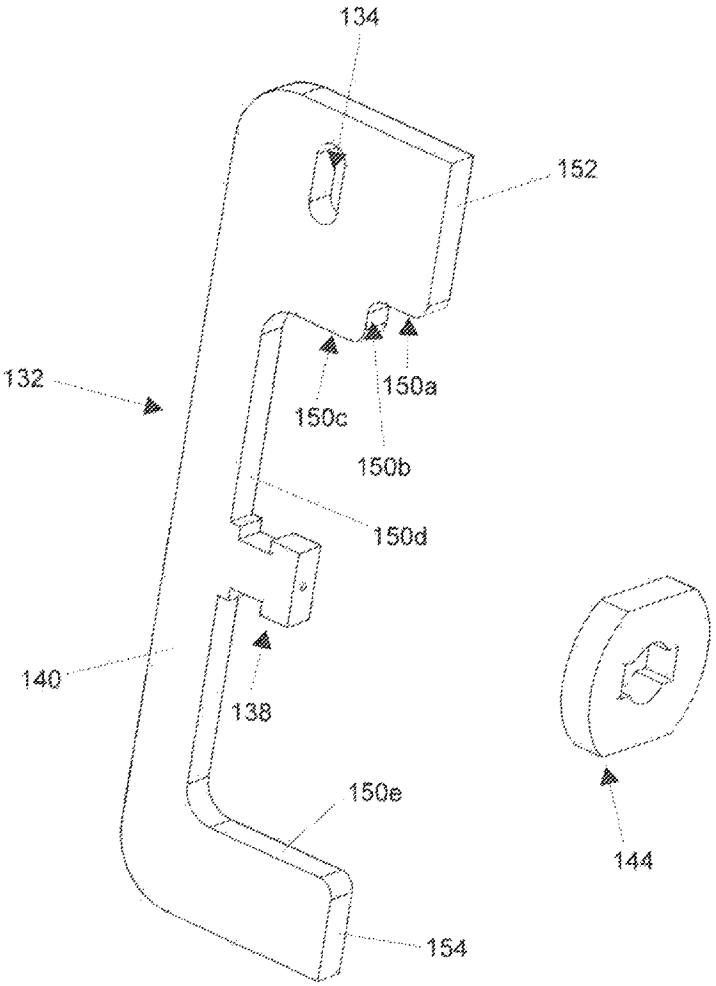
Figure 10:
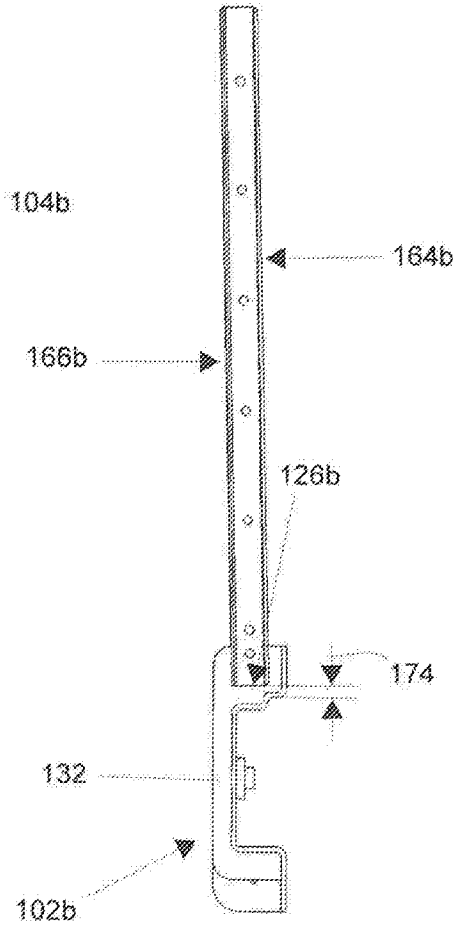

FIG. 4*a* is an enlarged view of a portion of FIG. 4;

FIG. 5 is a cross-sectional view of the safety landing of FIG. 1, taken along line 5-5;

FIG. 6 is an enlarged view of a portion of FIG. 5;

FIG. 7 is a perspective view of a portion of the safety landing of FIG. 1;

FIG. 8 is a partially exploded view of portions of the safety landing of FIG. 1;

FIG. 9 is a partially exploded view of portions of the safety landing of FIG. 1; and FIG. 10 is a cross-sectional view of a portion of the safety landing of FIG. 1 with the platform in an alignment position.

DETAILED DESCRIPTION

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors or owners do not intend to abandon, disclaim or dedicate to the public any such invention by its disclosure in this document.

Safety landings can be used in a variety of vertical and/or generally longitudinally extending shafts. On example of shafts that may include safety landings are sewer manholes. According to many Building Codes, manholes should include a safety landing for every 5 Meters of elevation. For example, a manhole between 5 meters and 10 meters deep may have one safety landing along its length, while manholes exceeding 10 meters in length may include two or more safety landings spaced along their extent. The general purpose of such safety landings is to help prevent a person from falling more than 5 meters (or any other prescribed distance) down the length of a shaft before encountering a safety landing that may interrupt his/her fall.

To allow passage along the length of the shaft, safety landings may include at least one openable platform portion. The platform portions may be provided as platforms, decking, hatches and the like. When the platform is in its closed position it may block, or at least substantially block the shaft (either alone, or in combination with other platforms). When the platform is moved to its open position, the shaft is unblocked and a user may pass the safety landing.

Optionally, the platforms can be locked or otherwise secured in its open position. This may allow the shaft to remain unblocked above a given user, and may help facilitate extraction of the user from the shaft and/or entry by rescue personnel if required. Preferably, the platform may be locked in the open position, such that the platform will tend to remain open until actively engaged and closed by the user. Optionally, the platforms may be automatically self-locking, such that the platform will tend to stay open without a user having to manually engage a latch or other such locking mechanism. Platforms of this nature may be openable with and securable in the open position with a single hand, which may be useful if the user is also carrying tools or other equipment down the shaft. Similarly, the locking mechanism for the platforms may be configured to be disengaged using a single hand, and optionally without requiring the user to manually disengage or unlock a separate locking member.

Some known safety landings are made from metals, such as aluminum or stainless steel. When used in harsh environments, such as sanitary sewer manholes, metal safety landings may tend to corrode or otherwise become damaged over extended periods of time. This can lead to weakening and possibly failure of the safety landings. As an alternative to metal, some or optionally substantially the entire safety landing can be formed from a composite or other non-metal material. Some options of suitable materials include fiberglass, fiberglass reinforced polymers, carbon fiber, plastics and the like. For example, a safety landing may be formed almost exclusively out of fiber reinforced polymer materials, with the possible exception of the mounting hardware that is used to secure the safety landing to the walls of the shaft. Optionally, the mounting hardware may be stainless steel or another suitable material.

Referring to FIG. 1, one example of a safety landing 100 includes a pair of opposing support panels 102*a* and 102*b* and a pair of platforms 104*a* and 104*b* extending between the support panels 102. In the illustrated example, each platform 104 is coupled to a corresponding support panel 102, and is movable between open and closed positions. As illustrated in FIG. 1, platform 104*a* is in the open position and platform 104*b* is in the closed position.

In the illustrated example, the support panels 102 are configured to be generally identical. This is not necessary, but may be preferable in some situations. The following description may on occasion refer to the features of one support panel 102 or platform 104, and it is understood that the other support panel and platform have analogous features, illustrated using analogous reference characters with "a" or "b" suffixes, and may operate in an analogous manner.

Figure 2:
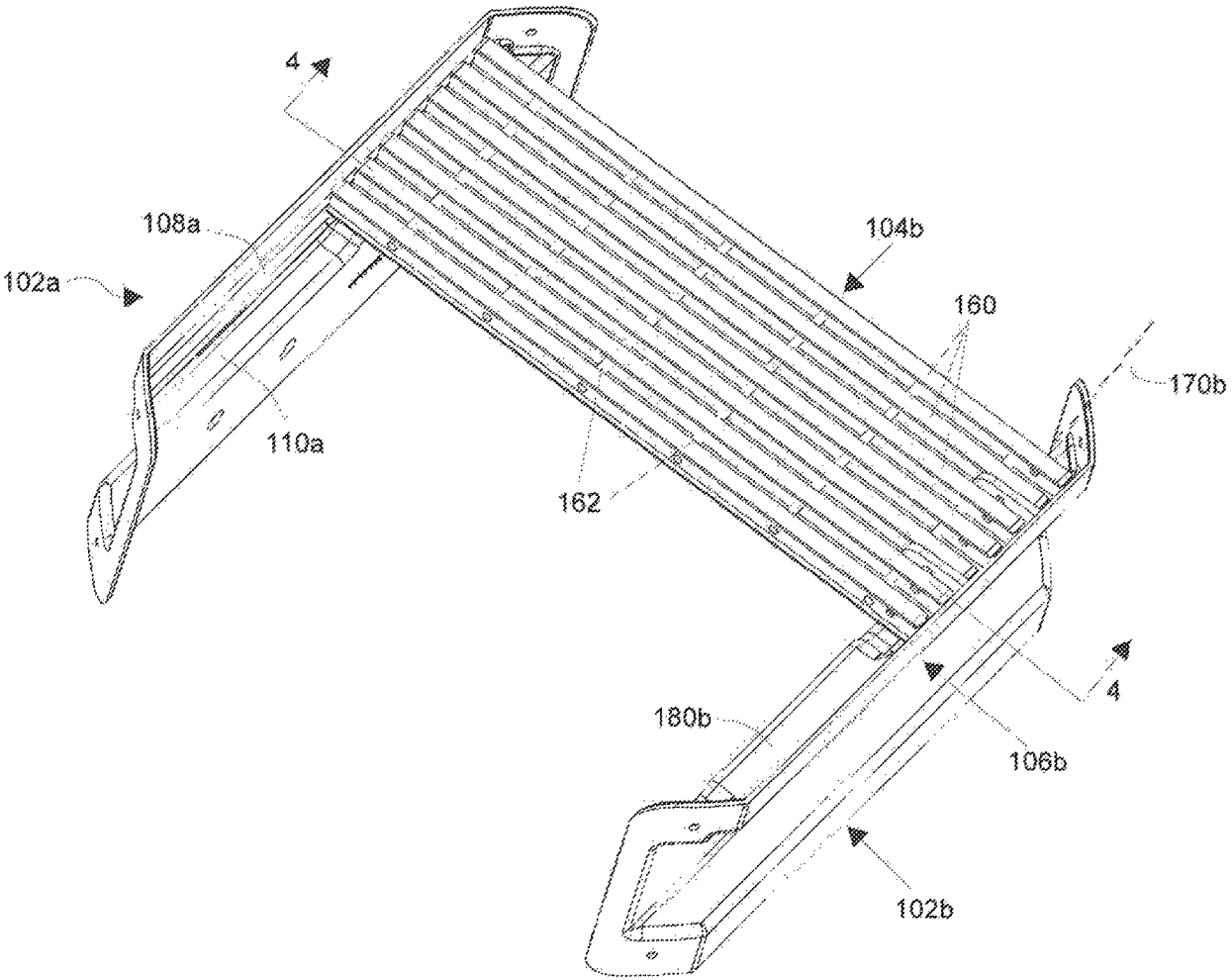
FIG. 2 is a perspective view of a portion of the safety landing of FIG. 1.

Referring to FIG. 2, the safety landing 100 is shown with platform 104*a* removed, thereby revealing the underlying structure of the support panels 102*a* and 102*b*. Referring also to FIG. 4, in the illustrated example the support panel 102*b* includes a generally single-layer body 106*b* having a generally C-shaped cross-sectional profile. The body 106*b* is generally linear and elongate, and includes a first support surface 108*b* and a second support surface 110*b* that is spaced apart from the first support surface 108*b*. The first support surface 108*b* is configured to support the corresponding platform 104*b* when it is in the closed position (FIG. 4), and the second support surface 110*b* is configured to support the platform when it is in the open position (FIGS. 5 and 6). Support panel 102*a* has analogous surfaces 108*a* and 110*a* (FIG. 2).

In the illustrated example, both the first and second support surfaces 108*b* and 110*b* are substantially planar surfaces and are generally parallel to each other. In this configuration, the second support surface 110*b* is also positioned laterally inboard of the first support surface 108*b*, and is positioned below the first support surface 108*b* in a longitudinal direction by a longitudinal offset distance 112.

Referring to FIG. 4*a*, in the illustrated example the first support surface 108*b* has an outer edge 114*b* and an inner edge 116*b*. A distance 118*b* between the edges 114*b* and 116*b* defines a depth of the first support surface 108*b* in the transverse direction. Similarly, the second support surface 110*b* includes an outer edge 120*b*, an inner edge 122*b* and a depth 124*b*. In the illustrated example, the depth 124*b* is greater than the depth 118*b*. The first and second support surfaces 108*b* and 110*b* may have any suitable depth, and in some embodiments, the second support surface 124*b* depth may be between be between 1 and 3 times the depth 118*b* of the first support surface, or more, and optionally may be between about 1.5 and about 2.5 times the depth 118*b* and may be about 2 times the depth 118*b*.

Optionally, the second support surface 110*b* (or 110*a*) can be sized so that it can support most, or optionally the entire end surface 126*b* of the platform 104*b*. For example, the second support surface can be sized so that its depth 124*b* is between about 50% and about 150% of the thickness 128 of the platform 104*b*, and may be between about 60% and about 100% and about 75% to about 95% of the thickness 128. Alternatively, the second support surface 110*b* may be relatively skinny, and the depth 124*b* may be less than 50% of the platform thickness 128.

Optionally, the support panel 102*b* (or 102*a*) can include one or more abutment surfaces that are also configured to engage the platform, particularly when in the open position, to help retain the platform in a desired position. For example, an abutment surface may be provided that engages portions of the platform when it is in the open position, and inhibits, and preferably prevents, the platform from returning to the closed position without involvement from a user. In such configurations, the abutment surface may form at least a part of a locking mechanism that helps keep the platform in the open position.

Referring to FIGS. 4 and 4*a*, in the illustrated example the support panel 102*b* includes an abutment surface 130*b* that is spaced from both the first and second support surfaces 108*a* and 110*b*. In this example, the abutment surface 130*b* is generally orthogonal to the first and second support surfaces 108*a* and 110*b*, and extends from the inner edge 116*b* of the first support surface 108*b* to the outer edge 120*b* of the second support surface 110*b*. When arranged in this manner, the abutment surface 130*b* and second support surface 110*b* may co-operate to help provide a generally L-shaped retaining shoulder that can inhibit pivoting of the panel 104*b* out of its open position, as explained further herein.

Optionally, the platforms 104*a* and 104*b* may be connected to their associated support panels 102*a* and 102*b* using any suitable coupling mechanism that can permit the platforms 104 to move between the open and closed positions. Optionally, the coupling mechanism can be configured to allow the platforms 104*a* and 104*b* to both pivot and translate relative to their support panels 102*a* and 102*b*. In such a configuration, each platform 104*a* and 104*b* may be lifted and pivoted relative to its support panel 102*a* and 102*b* when moving between the open position and the closed position.

Referring to FIG. 8, in the illustrated example the safety landing includes a coupling mechanism in the form of hinge brackets 132 that can be used to couple the platforms 104*a* and 104*b* to the support panels 102*a* and 102*b*. Each hinge bracket 132 is configured to be fastened to a respective support panel 102, and to pivotally and slidably support a platform 104. In the illustrated example, the hinge brackets 132 include slots 134 that are generally vertical and are configured to slidably receive corresponding hinge pins 136, and to allow the pins 136 (FIG. 4*a*) to translate along the length of the slots 132.

The hinge brackets 132 can be attached to the support panels 102 using any suitable method, including fasteners and adhesives, or alternatively may be integrally formed with the support panels. Referring to FIGS. 8 and 9, in the illustrated example the hinge brackets 132 each include an attachment protrusion 138 that extends outwardly from the body 140 of the bracket 132. The attachment protrusion 138 can be inserted through a corresponding aperture 142 in the sidewall 143*b* of the support panel 102*b* (FIG. 8), and can then be engaged by a retaining nut 144 (FIG. 9) to secure the hinge bracket 132 to the support panel 102 (see also FIGS. 1 and 4*a*). While shown with one attachment protrusion 138, each hinge bracket 132 may include two or more such protrusions.

Optionally, the hinge brackets 132 may also be configured to include one or more bearing surfaces that can engage, and bear against different portions of the support panel 102. This may help improve the connection between the hinge bracket 132 and the support panel 102. For example, engagement between bearing surfaces and portions of the support panel 102 may help distribute the expected loads across a larger total surface area. This may also help resist twisting and/or bending of the hinge brackets 132 relative to the support panel when loaded, which may be helpful in instances where the hinge brackets 132 are fastened to the support panel 102 at only one location.

Referring to FIG. 9, in the illustrated example the hinge brackets 132 are sized and shaped to generally follow the cross-sectional shape of the support panels 102, in the region proximate the first and second support surfaces 108 and 110.

Referring also to FIGS. 8 and 4*a*, in addition to the upward facing support surfaces 108*b* and 110*b*, in the illustrated example support panel 102*b* includes a generally downwardly facing anchor surface 146*b* that is the bottom of the generally C-shaped portion of the support panel 102*b*. The anchor surface 146*b* is generally parallel to, and underlies the first support surface 108*b* and the second support surface 110*b*. It also underlies and is generally orthogonal to the abutment surface 130*b*. In this example, the transverse depth 148 of the anchor surface 146*b* is generally equal to the combined transverse depths 118*b* and 124*b* of the first support surface 108*b*, second support 110*b* surface and encompasses the lateral extent of the abutment surface 130*b* (which is effectively zero in this example as the surface 130*b* is vertical). Alternatively, the anchor surface 146*b* may have a different configuration, and/or may be omitted entirely from the support panel.

Referring to FIG. 9, in this example, each hinge bracket 132 has a plurality of bearing surfaces that are configured to engage and bear against respective portions of the support panel 102 when the hinge bracket 132 is attached. For example, the bearing surfaces 150*a*, 150*b*, 150*c*, 150*d* and 150*e*, will bear against the first support surface 108*b*, abutment surface 130*b*, second support surface 110*b*, panel sidewall 143*b* and anchor surfaces 146*b* respectively. In addition, the upper and lower side faces 152 and 154 of the hinge bracket 132 are positioned so that they will bear against upper and lower flanges 156*b* and 158*b* (FIGS. 8 and 4*a*) that extend vertically from the top and bottom of the support panel 102*b*.

Figure 3:
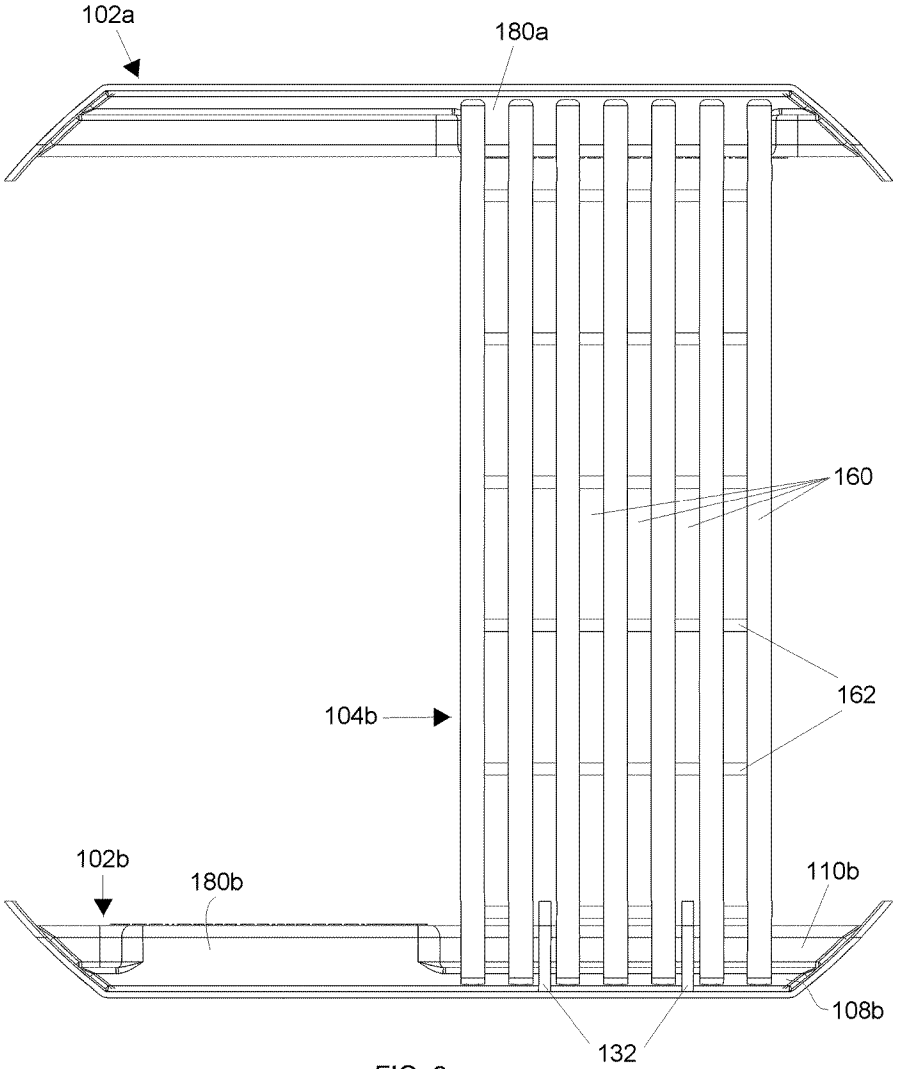
FIG. 3 is a top view of the portion of the safety landing of FIG. 2.

Referring also to FIG. 3, each platform 104 in the illustrated example is formed from a plurality of parallel planks 160 that are joined together using cross-members 162. In this configuration, hinge pins 136 extend between adjacent ones of the planks 160 and are located within the body of the platforms 104 such that the pins 136 are between the opposed ends of the platforms 104, and between the upper and lower surfaces 164 and 166 (see for example surface 164*b* and 166*b* in FIG. 4*a*). When the pins 136 are inserted into the corresponding slots 134, the platform 104 can pivot about a pivot axis 170 (see axis 170*a* in FIG. 1 and Axis 170*b* in FIGS. 2 and 4*a*) relative to the hinge brackets 132, and relative to the support panel 102. As the pins 136 slide within the slots 132, the pivot axis 170 can also translate.

Alternatively, in other examples, the platforms 104 may be of any suitable configuration and the pins 136 may be located in any suitable location. Further, the platforms 104*a* and 104*b* need not have the same design as each other.

When the safety landing 100 is in use, a user may optionally open and close the platforms 104*a* and 104*b* in accordance with the following the following method. Referring to FIG. 4, when the platform 104*b* is in the closed position the lower surface 166*b* of the platform 104*b* rests on the first support surface 108*a* and the pins 136 are positioned toward, the middle of the slots 134 in the hinge brackets 132. To open the platform 104*b*, a user can lift the far end of the platform 104*b* (the left end as illustrated in FIG. 4) upwardly, which may cause the platform 104*b* to initially pivot about the pivot axis 170*b*. As the platform 104*b* pivots, engagement between the lower surface 166*b* and the first support surface 108*b* may lift the platform 104*b* in the vertical direction, thereby also shifting the pivot axis 170*b* upwards. As the pivoting continues, the end surface 126*b* of the platform 104*b* may also engage the first support surface 108*b*. As the platform 104*b* continues to pivot it may approach an alignment position (FIG. 10) in which both the lower surface 166*b* and end surface 126*b* have been pivoted out of contact with the first support surface 108*b*. In the illustrated example, the platform 104*b* is generally vertical when it is in the alignment position. In the illustrated example, the end surface 126*b* is temporarily spaced above the first support surface 108*b* by an alignment offset distance 174. The distance 174 may be any suitable distance, and is illustrated in an exaggerated manner in FIG. 10 for clarity. In some embodiments, the distance 174 may be between about 0 mm and about 50 mm or more. Providing a distance 174 that is close to 0 mm may be achieved if the platform 104*b* is pivoted to an orientation in which the end surface 126*b* is generally co-planar with, but is offset laterally inwardly from the first support surface 108*b*.

In addition to, or as an alternative to, the engagement between surfaces as described, a user may also apply a lifting force to the platform 104*b* to lift it upwardly relative to the support panel 102*b* while generally simultaneously pivoting the platform 104*b*. If a user lifts the platform 104*b* sufficiently, some of the described interaction between the lower surface 166*b* and/or end surface 126*b* and the first support surface 108*b* may be omitted.

When in the alignment position (FIG. 10), the platform 104*b* is no longer being supported by the first support surface 108*b* and, absent a lifting force from the user; the platform 104*b* will fall downwardly under the influence of gravity toward the second support surface 110*b*. As the platform 104*b* falls, the pivot axis 170*b* may also shift downwardly (relative to its location when the platform 104*b* is in the alignment position of FIG. 10). Referring also to FIGS. 5 and 6, longitudinally downward movement of the platform 104*b* is then limited by engagement between the end surface 126*b* and the second support surface 110*b*. When the end surface 126*b* is resting on the second support surface 110*b* the upper surface 164*b* of the platform 104*b* is facing and adjacent to the abutment surface 130*b*, and optionally abuts the abutment surface 130*b*.

When in this position, pivoting of the platform 104*b* in an inward direction (i.e. toward the closed position), as illustrated using arrow 176 in FIG. 5, is at least partially inhibited by the engagement between the end surface 130*b* and the second support surface 110*b*. In addition, pivoting of the platform 104*b* may be further inhibited by engagement between the upper surface 164*b* and the abutment surface 130*b*. This engagement can effectively lock the platform 104*b* in the open position, as the platform 104*b* will not freely pivot inwardly toward the closed position. As the platform 104*b* will tend to fall longitudinally downwardly from the alignment position into the open position under the influence of gravity, it will tend to remain open due to interference between opposing surfaces 130*b* and 110*b*, and 164*b* and 130*b*, in lieu of an active lock or latch mechanism, and can be described as automatically self-locking.

When a user wishes to close the platform 104*b*, the previous steps can be reversed. In particular, the user can lift the platform 104*b* vertically from the open position into the alignment position, so that the end surface 130*b* is spaced from the second support surface 110*b* and the upper surface 164*b* is spaced from the abutment surface 130*b*. In the illustrated example, the platform 104*b* can be lifted from the open position to the alignment position freely, without having to disengage any active locks, latches or the like. That is, in this example a user need only lift the platform 104*b* vertically, and this may be achieved using a single hand in some circumstances. From the alignment position, the platform can be pivoted about the pivot axis 170*b* and returned to the closed position.

Optionally, each support panel 102 may also include one or more receiving surfaces configured to support the free end of a platform that is connected to an opposing support panel. For example, if support panels 102*a* and 102*b* are arranged opposite each other each support panel 102 may be pivotally connected to a respective platform 104, as well as being configured to support the platform 104 extending from the opposing support panel 102. For example, referring to FIGS. 2 and 3, in the illustrated example each support panel 102 includes a respective receiving surface 180*a* and 180*b* for engaging and supporting the lower surface 166*a* or 166*b* of the platform 104*a* and 104*b* extending from the opposing support panel 102*a* and 102*b*. In this example, the receiving surfaces 180 are laterally spaced apart from the first and second support surfaces 108 and 110.

Optionally, the receiving surfaces 180 can be configured to be a generally planar surface (as illustrated) and may be positioned so that they are co-planar with the first support surface 108*a* and 108*b* on the respective support panel 102*a*, 102*b*. In such a configuration, the platform 104*b* being supported on the first support surface 108*b* and the receiving surface 180*a* may be generally level, and optionally may be even with platform 104*a* that is supported on first support surface 108*a* and receiving surface 180*b*. This may help provide a generally smooth surface to support a user when both platforms 104 are closed. Alternatively, the receiving surfaces 180 need not be co-planar with the first support surfaces 108, and need not have a planar configuration. For example, the receiving surfaces 180 may include bosses, protrusions, curved portions, inclined surfaces and a variety of other suitable configurations that are compatible with the lower surface of the platform that is to be supported.

In the illustrated example, the hinge brackets 132 include the slots 134, and the platforms 104 non-translatably receive the hinge pins 136. Alternatively, the platforms 104 may include slots, and the pins may be associated with the hinge brackets 132. Further, while separate hinge pins 136 are used in the illustrated example, the hinge pins may be attached to and/or integrally formed with the hinge brackets 132 and/or platforms 104. For example, the platforms 104 may include protrusions or bosses that can slide within the slots rather than using separate pins.

Preferably, the hinge brackets 132 used on a given support panel, and optionally on multiple support panels 102, have the same configuration and are generally interchangeable with each other. This may help reduce the manufacturing costs of the safety landing, and may help simplify assembly of the safety landing. This may also help simplify repairing the safety landings as common repair parts can be used on multiple landings.

Optionally, each support panel 102 may include one or more attachment portions for attaching the support panels to the shaft or other surrounding structure. The attachment portions may be of any suitable configuration. Referring to FIG. 7, in the illustrated example and with reference to support panel 102*a*, the attachment portions 184*a* include flanges 186*a* extending from opposing ends of the support panel 102*a*. Each flange 186*a* has a pair of holes 188 to receive mounting fasteners (not shown). In some situations, the fasteners may be bolts or other suitable anchors that can connect the support panel to the walls of the shaft. While two holes are shown, the flanges 186*a* may include any suitable number of holes 188 (such as one hole, or three or more holes) and the holes may be arranged in any suitable configuration.

Optionally, the support panels 102 may be of integrally formed, one-piece construction. For example, this may help reduce the number of components that are needed to build the safety landing, and may help simplify assembly/construction of the safety landing.

While illustrated as a substantially vertical surface in the current example, the abutment surfaces 130*a* and 130*b* may have any suitable configuration and orientation, and need not be planar or vertically oriented.

While it may be helpful for both platforms 104 to openable as illustrated, so that a large portion of the shaft is accessible, in some configurations only one of the platforms 104 may be openable and the other may be fixed in the closed position.

While support panels 102*a* and 102*b* are identical in the illustrated example, in other embodiments they may have different configurations. For example, one of the support panels may be a simple cross-bar or other such structure that can support one end of a platform, and need not have all of the features of the support panels described herein.

Optionally, the safety platform 100 may include only a single support panel 102 that pivotally supports both platforms 104 and 104*b*. The opposing ends of the platforms 104 may be supported directly by the walls of the shaft, or any other supporting member that is connected to the shaft, when in the closed position.

While shown with two support panels and two platforms, a safety landing may include a different number of support panels or platforms. For example, a panel may be configured to support three or more platforms along its width. In such examples, the panel may be pivotally connected to all three platforms and include three pairs of first and second support surfaces 108 and 110. Alternatively, the panel may be pivotally connected to only one or two of the platforms, having only one or two sets of first and second support surfaces 108 and 110, and may support the free end of an opposing third platform on a suitable receiving surface (such as surface 180). If at least one platform is pivotally connected to an opposing panel, the platforms may be arranged in any order or arrangement that is suitable, including for example having platforms that are pivotally coupled to the same panel being positioned adjacent each other or alternatively being positioned on opposite sides of a platform that is coupled to and extending from an opposing panel.

The number of platforms and their pivoting arrangement (i.e. which panel they are coupled to) may be selected based on a number of factors for a given safety landing, including the size and configuration of the shaft, the configuration of the platforms and the intended use and access desired.

What has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. A safety landing for use in a longitudinally extending shaft, the safety landing comprising:

a) a first support panel positionable within the shaft, the first support panel comprising at least one attachment portion for attaching to the shaft, a first support surface and a second support surface spaced apart from the first support surface;

b) at least a first platform having a first end that is movably connected to the first support panel and a second end spaced apart from the first end, the first platform having an upper surface, an opposing lower surface and an end surface at the first end, the first platform being movable between:

i) a closed position in which upper surface of the platform is upward facing to support a user and the first platform extends laterally across the shaft, and in which the lower surface rests on the first support surface; and ii) an open position in which the first platform is generally upright and the end surface of the first platform rests on the second support surface.

2. The safety landing of claim 1, wherein the first platform is pivotably and translatably connected to the first support panel wherein the first platform is lifted and pivoted relative to the first support panel when moving between the open position and the closed position.

3. The safety landing of claim 1, further comprising an abutment surface that is spaced apart from the first and second support surfaces, and wherein when the first platform is in the closed position the upper surface is spaced from the abutment surface, and when the first platform is in the open position the upper surface is adjacent and faces the abutment surface.

4. The safety landing of claim 3, wherein when the first platform is in the open position, engagement between the abutment surface and the upper surface and between the end surface and the second support surface inhibits the first platform from pivoting relative to the first support panel whereby the first platform is self-locking in the open position, and wherein the first platform can only be pivoted from the open position to the closed position after the first platform has been translated upwardly so that the abutment surface is spaced from the upper surface and that the end surface is spaced from the second support surface.

5. The safety landing of claim 4, wherein the first platform can only be pivoted from the open position to the closed position after the first platform has been translated upwardly so that the end surface is longitudinally above the abutment surface.

6. The safety landing of claim 3, wherein the abutment surface extends between a laterally inner edge of the first support surface to a laterally outer edge of the second support surface.

7. The safety landing of claim 3, wherein the abutment surface is generally orthogonal to the second support surface.

8. The safety landing of claim 2, wherein when the first platform is pivoted from the closed position toward the open position engagement between at least one of the lower surface and end surface and the first support surface lifts the first platform relative to the first support panel until the first platform reaches an alignment position in which the lower surface and end surface are spaced apart from the first support surface, and wherein the first platform falls from the alignment position to the open position under the influence of gravity.

9. The safety landing of claim 1, wherein the second support surface is longitudinally below the first support surface.

10. The safety landing of claim 1, wherein the second support surface is laterally inboard of the first support surface.

11. The safety landing of claim 1, further comprising a hinge bracket connecting the first platform to the first support panel, wherein one of the hinge bracket and the first platform includes a slot and wherein a pin that pivotally connects the hinge bracket and the first platform is pivotally and translatably received within the slot.

12. The safety landing of claim 11, wherein the first support panel comprises a downward facing anchor surface that underlies the second support surface and a longitudinally extending sidewall extending between the second support surface and the anchor surface, and wherein the hinge bracket has first, second and third bearing surfaces that abut the second support surface, the anchor surface and the sidewall respectively.

13. The safety landing of claim 12, wherein the anchor surface also underlies the first support surface and the hinge bracket includes a fourth bearing surface that abuts the first support surface.

14. The safety landing of claim 11, wherein one of the hinge bracket and the first support panel comprises an integrally formed attachment protrusion that extends through an aperture formed in the other one of the hinge bracket and the sidewall and is secured using a fastener, thereby fastening the hinge bracket and first support panel together.

15. The safety landing of claim 1, wherein the first support panel further comprises a receiving surface for supporting a lower surface of a second platform extending from an opposing second support panel positioned within the shaft.

16. The safety landing of claim 15 wherein the receiving surface is laterally spaced apart from the first support surface and is co-planar with the first support surface.

17. The safety landing of claim 1, further comprising:

a) a second support panel positionable within the shaft opposite the first support panel, the second support panel comprising at least one attachment portion for attaching to the shaft, a first support surface and a second support surface spaced apart from the first support surface;

b) a second platform having a first end that is movably connected to the second support panel and a second end spaced apart from the first end, the second platform having an upper surface, an opposing lower surface and an end surface at the first end, the second platform being movable between:

i) a closed position in which upper surface of the second platform is upward facing to support a user and the second platform extends laterally across the shaft, and in which the lower surface of the second platform rests on the first support surface of the second support panel; and ii) an open position in which the second platform is generally upright and the end surface of the second platform rests on the second support surface of the second support panel.

18. The safety landing of claim 17, wherein the first support panel comprises a first receiving surface that is spaced apart from the first support surface and the second support panel comprises a second receiving surface that is spaced apart from the first support surface on the second support panel, and wherein when the first and second platforms are in the closed position the lower surface of the first platform rests on the second receiving surface and the lower surface of the second platform rests on the first receiving surface.

19. The safety landing of claim 1, wherein the first support surface has a first depth in the lateral direction and the second support surface has a second depth in the lateral direction that is between about 1.5 and 2.5 times the first depth.

20. The safety landing of claim 1, wherein the spacing between the upper and lower surfaces defines a first platform thickness and the second support surface has a second depth in the lateral direction that is between 50% and about 150% of the first platform thickness.

21. A safety landing for use in a longitudinally extending shaft, the safety landing comprising:

a) a support panel positionable within the shaft, the support panel comprising at least one attachment portion for attaching to the shaft, an upwardly facing first support surface, an upwardly facing second support surface spaced horizontally apart from and at an elevation below the first support surface, and a horizontally facing abutment surface between the first and second support surfaces;

b) a platform having a first end movably connected to the first support panel, a second end opposite the first end, an upper surface having an engagement portion adjacent the first end, a lower surface opposite the upper surface, and an end surface at the first end, the first platform movable between:

i) a closed position in which the platform extends horizontally across the shaft with the upper surface of the platform directed upwardly to support a user and the lower surface of the platform resting on the first support surface; and ii) an open position in which the platform is generally upright with the engagement portion of the upper surface adjacent and facing the abutment surface and the end surface of the platform resting on the second support surface, and in which the platform is inhibited from pivoting toward the closed position via engagement between the engagement portion and the abutment surface and between the end surface and the second support surface, and wherein the platform is pivotable back toward the closed position only after the platform is translated upwardly from the open position so that the end surface is lifted off the second support surface and the engagement portion of the upper surface is raised to an elevation above the abutment surface.

* * * * *